US008827743B1

(12) United States Patent
Maury

(10) Patent No.: US 8,827,743 B1
(45) Date of Patent: Sep. 9, 2014

(54) RF COAXIAL CONNECTORS

(71) Applicant: Maury Microwave, Inc., Ontario, CA (US)

(72) Inventor: Marc A. Maury, Pomona, CA (US)

(73) Assignee: Maury Microwave, Inc., Ontario, CA (US)

( * ) Notice: Subject to any disclaimer, the term of this patent is extended or adjusted under 35 U.S.C. 154(b) by 0 days.

(21) Appl. No.: 13/945,685

(22) Filed: Jul. 18, 2013

(51) Int. Cl.
*H01R 9/05* (2006.01)

(52) U.S. Cl.
USPC ..... 439/578; 439/675

(58) Field of Classification Search
USPC ..... 439/578, 675
IPC ..... H01R 9/05,9/0521, 24/38, 33/20
See application file for complete search history.

(56) References Cited

U.S. PATENT DOCUMENTS

| | | | | |
|---|---|---|---|---|
| 3,292,136 | A | 12/1966 | Somerset | |
| 3,340,495 | A | 9/1967 | Weinschel | |
| 3,601,776 | A | 8/1971 | Curl | |
| 4,561,716 | A | 12/1985 | Acke | |
| 4,846,714 | A | 7/1989 | Welsby et al. | |
| 4,891,015 | A | 1/1990 | Oldfield | |
| 4,929,188 | A | 5/1990 | Lionetto et al. | |
| 4,941,846 | A | 7/1990 | Guimond et al. | |
| 5,401,175 | A | 3/1995 | Guimond et al. | |
| 5,435,745 | A | 7/1995 | Booth | |
| 5,879,188 | A * | 3/1999 | Clyatt | 439/578 |
| 5,938,465 | A | 8/1999 | Fox, Sr. | |
| 6,174,206 | B1 * | 1/2001 | Yentile et al. | 439/638 |
| 6,210,221 | B1 * | 4/2001 | Maury | 439/578 |
| 6,396,367 | B1 * | 5/2002 | Rosenberger | 333/260 |
| 7,347,727 | B2 * | 3/2008 | Wlos et al. | 439/578 |

OTHER PUBLICATIONS

Mario A. Maury, Jr., Microwave Coaxial Connector Technology: A Continuing Evolution; 2005.

* cited by examiner

*Primary Examiner* — Hien Vu
(74) *Attorney, Agent, or Firm* — Larry K. Roberts

(57) ABSTRACT

A male coaxial connector structure for mating with a corresponding female connector structure to provide electrical connections at microwave frequencies. The male coaxial connector structure includes a coaxial outer conductor structure having a central longitudinal axis and a central open region, with a face region at a leading end of the outer conductor structure, defining a continuous uninterrupted coaxial outer conductor surface. An outer compression finger structure is disposed outside of and adjacent the coaxial outer conductor surface and having a plurality of longitudinally oriented slots forming individual finger regions. The face region is configured to contact a corresponding face surface of the female connector structure with the male and female connectors mated together. The finger regions of the outer compression finger structure are configured to compress to fit into the outer conductor receptacle of the female connector.

20 Claims, 6 Drawing Sheets

RF COAXIAL CONNECTORS

BACKGROUND

In testing microwave devices with coaxial connectors, it is desirable to provide a connection which can be made quickly while providing low VSWR (Voltage Standing Wave Ratio), high isolation, and most importantly, repeatable measurements, ideally exhibiting repeatability greater than 40 dB. It is also desirable that the connection be stable and not require any external fixturing to insure repeatability, but may require support when used on a cable or test device which would normally require support during test.

Various quick disconnect coaxial connectors are described in U.S. Pat. Nos. 4,846,714; 4,891,015; 4,941,846; and 5,401,175. All of the above employ relatively complex and expensive methods for achieving a quick connect/disconnect feature for coaxial connectors.

A microwave quick connect/disconnect coaxial connector is described in U.S. Pat. No. 6,210,221 B1, by Marc A Maury.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1:
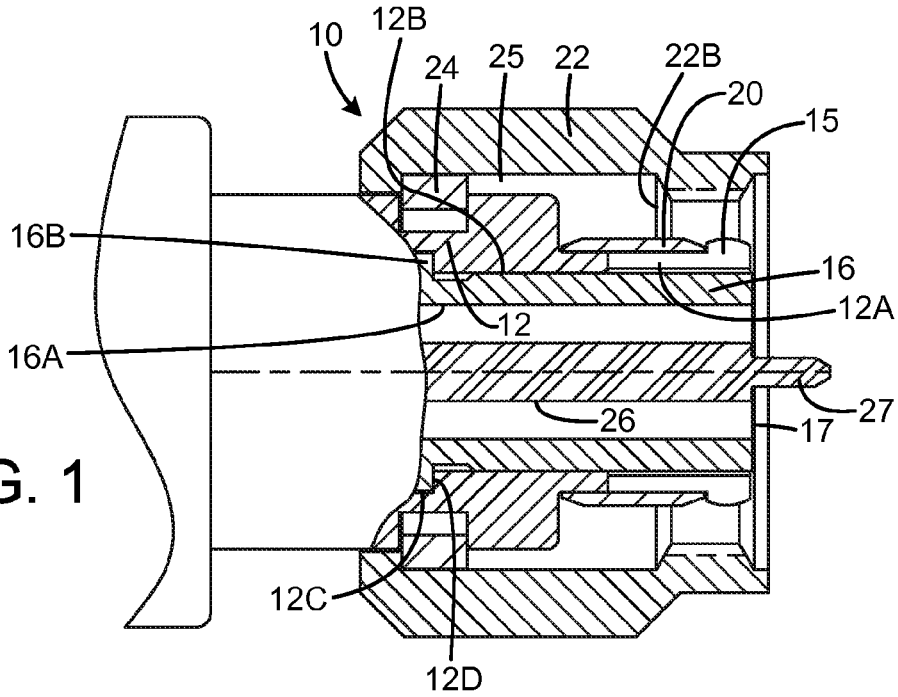
FIG. 1 is a partially broken-away, cross sectional view of a connector type embodying aspects of this invention, showing the configuration of the solid outer conductor, the compression fingers and the placement of the shield ring, the nut and the retaining ring.

In the following detailed description and in the several figures of the drawing, like elements are identified with like reference numerals. The figures may not be to scale, and relative feature sizes may be exaggerated for illustrative purposes.

Two exemplary embodiments of a new male coaxial connector are described, both using a solid (i.e. continuous) coaxial transmission line outer conductor surface and an outer slotted finger structure. One embodiment uses a slotted shield ring covering a region of the slots in the finger structure and located in a recess area behind the contacting surfaces of the outer slotted finger structure, and a second embodiment does not use a shield ring.

One unique feature is the coaxial transmission line outer conductor of this coaxial connector is not slotted, and includes a continuous outer surface in combination with the outer slotted finger structure, thereby maintaining the physical integrity of the outer conductor and eliminating RF discontinuity and leakage path for the RF connector. This is sometimes referred to herein as a "solid" outer coaxial conductor structure, referring to the outer coaxial conductor surface, but it will be understood that the outer coaxial structure is hollow, defining an interior region, into which the inner conductive coaxial structure is fitted, and the open region between the inner and outer coaxial structures is typically filled with a dielectric material, such as air or Teflon™. The compression fingers in conjunction with the shield ring can also provide RF shielding capabilities. The compression fingers exert outward axial forces against mating components of the female connector as well as lineal directional pressure to exert force at the interface plane of the connectors and ensure good contact. An exemplary embodiment of the male connector can be mated to a corresponding female connector and connected and disconnected using a simple push on/pull off motion without the need for other action.

The male connector may be used with an optional integral coupling nut to provide the option of a threaded coupling when performing calibration, or when verification of the measurement is desired. When used, the coupling nut provides engagement of one to two threads in one embodiment, providing the ability to quickly thread or unthread the mating connectors, or allowing a torqueable mating using industry standard torque wrenches.

Exemplary embodiments of a multi-function connector can be used to measure devices that utilize various types or sizes of female connectors, e.g., 2.4 mm female connectors. The female connector of these series connectors conventionally mate with a male connector that is screwed on and typically requires five to six revolutions of the coupling nut to mate.

The simplicity and ease of use of the connectors, plus the relatively low cost to manufacture, provides the user a low cost alternative to the more complex and costly methods currently available today.

Similar connectors can be provided using this coupling technique in connector types such as 1.0, 1.85, 2.92 and 3.5 mm and other sexed connectors with similar constructions.

An exemplary embodiment of a male connector 10 is illustrated in FIGS. 1-8, having a coaxial outer conductor structure 16 which defines a conductive uninterrupted outer coaxial surface 16A. The coaxial outer conductor 16 is fitted inside a connector body defining an outer compression finger structure 12 having a plurality of compression finger regions 15. In this exemplary embodiment, the outer coaxial line surface 16A has a cylindrical configuration. The structure 16 includes an outer flange 16B at its interior end. The outer compression finger structure 12 has an internal cylindrical surface 12B, with a relieved region or recess 12C, defining a shoulder surface 12D at the interior end of the structure 12. The inner diameter (ID) of the cylindrical surface 12B is slightly larger than the outer diameter (OD) of the coaxial outer conductor 16, allowing the outer conductor structure 16 to be fitted into the structure 12, with flange 16B fitting into the peripheral recess 12C and registering in axial position against the shoulder 12D. In an exemplary embodiment, the outer conductor 16 is kept in place and grounds securely to the connector body 12 by compression applied by a threaded bushing that engages from the back of the connector body 12 and captivates the dielectric and the outer conductor 16. A press fit or an adhesive could be used as an alternative or it could be threaded in place.

A slotted shield ring 20 is fitted over finger regions 15 of the compression finger structure 12, and is configured such that, when compressed, exerts circumferential pressure to the walls of the outer coaxial conductor receptacle 52B in the female connector 50, adding additional retention force to the compression finger regions 15 and resulting in electrically repeatable mating. This embodiment yields a quick disconnect configuration that provides excellent electrical specifications, and with the use of heat treated beryllium copper, phosphor bronze or other suitable conductive material for all conductive parts, also provides long life and reliable test characteristics.

Figure 9:
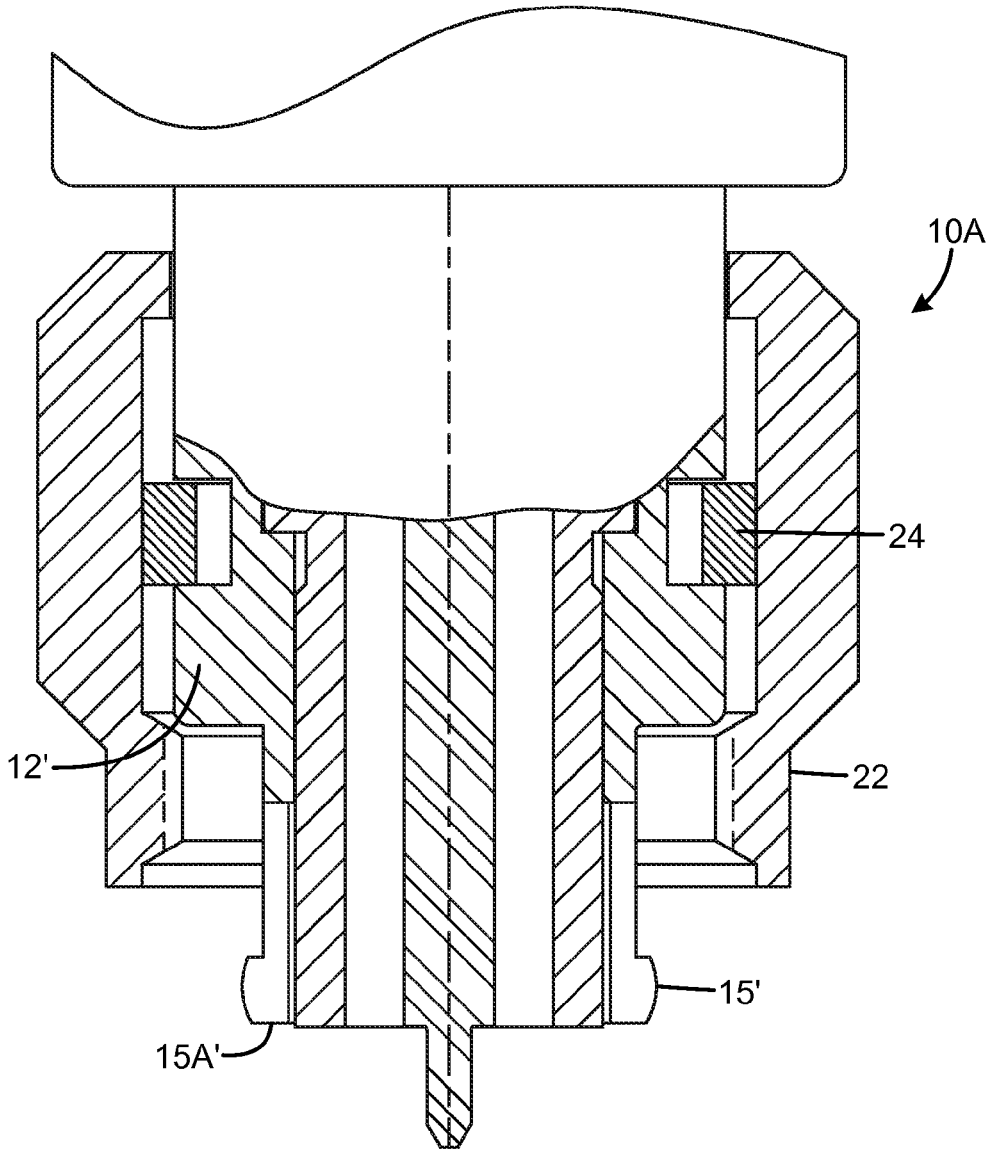
FIG. 9 shows an alternate embodiment of a connector, in which a shield ring is not used.

Another embodiment of a male connector 10A is illustrated in FIG. 9, having a solid outer conductor 16 and a slotted compression finger structure 15', and does not use a shield ring as in the embodiment of FIGS. 1-7. This exemplary embodiment also exerts circumferential pressure on the receptacle of the mating female connector, providing adequate retention force to the mated pair of connectors to ensure electrically repeatable mating.

The connector structures 10 and 10A include a solid uninterrupted coaxial outer conductor surface, with a compression finger structure 12 or 12' around the circumference of the outer conductor 16, and having a plurality of slots 14 (FIG. 3) formed longitudinally from the leading edge 15A or 15A' of the compression finger regions 15 or 15'. The slots 14 separate the finger regions in the compression fingers structure 12 or 12'.

In an exemplary embodiment, the slots 14 and finger regions 15, 15' have a suitable length to be spread to provide adequate axial retention force when compressed into the outer conductor receptacle 52B of a female connector 50.

Figure 4:
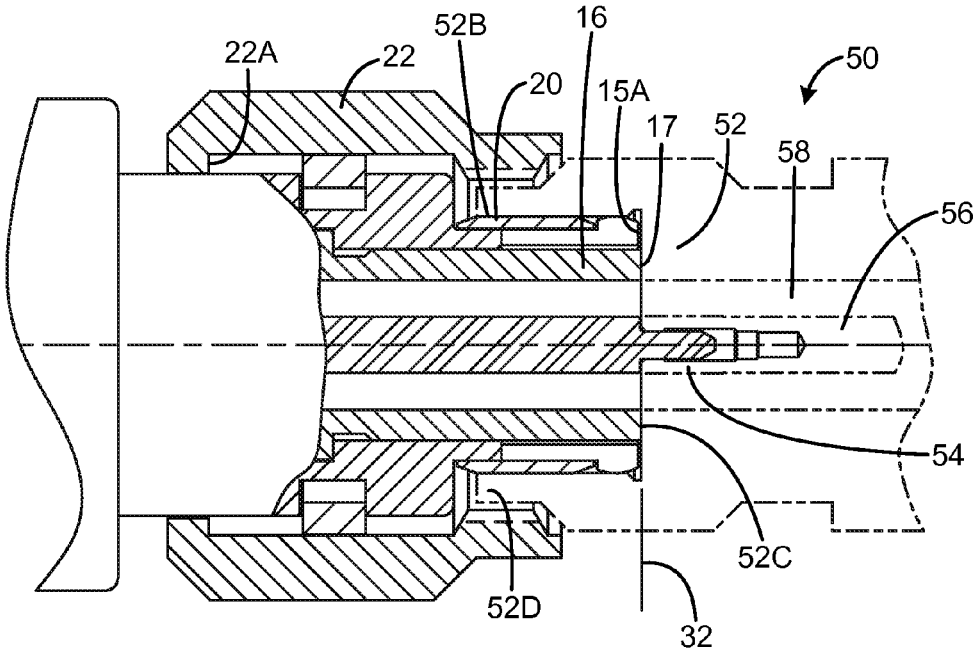
FIG. 4 is a partially broken-away, cross sectional view showing the connector of FIG. 1 mated with a female connector, showing the nut in the retracted position.
Figure 5:
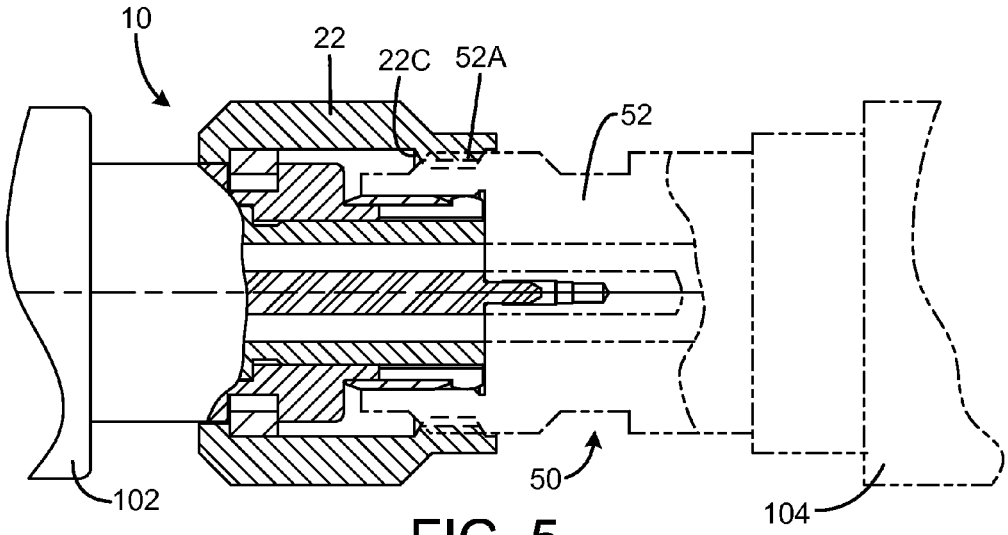
FIG. 5 is a partially broken-away, cross sectional view similar to FIG. 4, but showing the connector mated with a female connector showing the nut in a forward threaded position.
Figure 6:
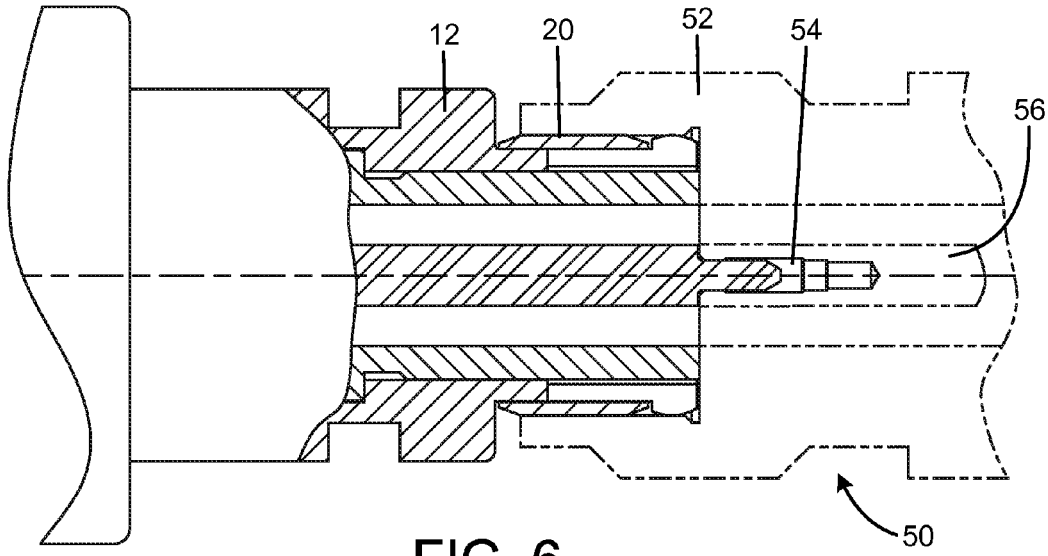
FIG. 6 is a cross sectional view similar to FIG. 5, less the nut and retaining ring.

The configuration of the leading edge 17 of the coaxial outer conductor 16 is flat or convex, ensuring intimate contact is made at the interface plane 32 exactly at the contact point of the coaxial outer conductors 16 of both the male 10 and 10A connector embodiments and the coaxial outer conductor defined by structure 52 and mating leading edge 52C of female connector 50 (FIGS. 4-6). This provides for an uninterrupted coaxial outer conductor system and results in excellent electrical performance.

The leading edges 15A of the compression fingers 15 are radiused at 15B with a smooth finish to provide a smooth wiping action when inserting into the receptacle of the mating female connector; in an alternate embodiment they can also be grooved to provide additional retention force, or a combination of the two.

The face 15A of the compression fingers 15 is recessed behind the face 17 of the coaxial outer conductor 16 and at the mating plane 32 to ensure there is always intimate contact between the mating surfaces 17, 52C of the outer conductors 16, 52 of both connectors 10 or 10A and 50 at the mating plane 32.

The configuration of the leading end 16 features a flat end surface 17 to rest against a corresponding flat end surface 52C of the female connector, thus minimizing any discontinuity at these mating surfaces of the respective connector structures.

A split compression ring 20 encircles the compression finger structure 15 at region 12A, and is designed to exert force on the inner surface 52B (FIG. 4) of the female connector 50 at distal region 52D and provide mechanical stability. The ring is split to facilitate assembly onto the finger regions 15 of the outer compression finger structure 12. In this exemplary embodiment, the split ring 20 is fabricated of heat treated beryllium copper, and is spread and held during the heat treatment to yield a ring diameter that provides optimal pressure against the inner surface 52B of the mating female connector. Further, the ring is provided with a 30 degree lead-in chamfer on the outer diameter to assist entry into the female connector. As the ring compresses, it reduces the air gap between it and the outer diameter of the compression fingers 15. This in turn reduces RF leakage through the slots 14 in the compression fingers and eliminates radiation over a rated operating frequency range of the connector, which in this exemplary embodiment is from 0 to 50 GHz.

The finger regions 15 are spread to provide a compression fit with the inner circumferential surface of the female connector. The outer diameter of the outer structure 12 at the radiused end of the outer conductor structure 12 is machined to a diameter of 0.1886 inch+/−0.0005 inch, in an exemplary embodiment, and the finger regions are then spread and heat treated with the diameter set at 0.1946 inch+/−0.001 inch. The inner diameter of the corresponding female outer connector structure at its leading end for this embodiment is 0.1878 inch+/−0.001 inch, and so the outer diameter of the outer structure at the leading end is slightly oversized with respect to the female connector structure. When engaged with the female connector structure, the inner surface of the female connector structure forces the spread finger regions 15 together and returns the ID of outer conductor structure 12 at the slotted finger regions to the nominal OD of the coaxial outer conductor sleeve 16. The radiused leading end surfaces of the finger regions facilitate the engagement with the female connector structure.

A minimal air gap 12E separates the inner surfaces of the finger region 15 of compression finger structure 12 and the outer surface of the coaxial line outer conductor 16. This allows the finger regions 15 to flex beyond a nominal ID and takes into account tolerance variations contributed by the mating parts 10, 10A and 50.

Figure 7:
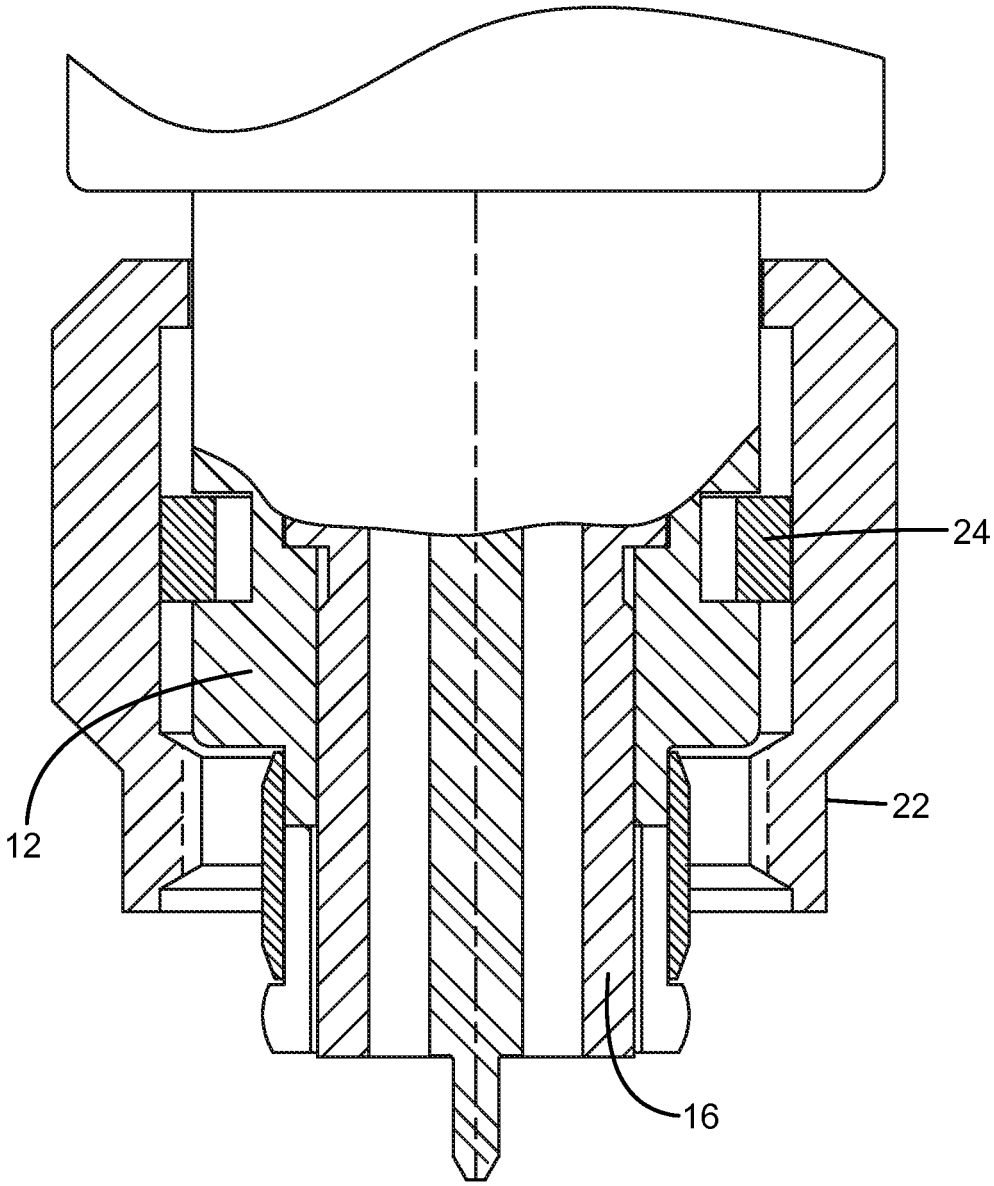
FIG. 7 is a cross-sectional view depicting the connector structure with the nut and retaining ring.

A threaded coupling nut 22 with reduced thread engagement is held in place by a retaining ring 24. The coupling nut 22 is fabricated with an inner area between shoulders 22A, 22B of increased diameter, forming an elongated relief area 25. This relief area allows the coupling nut 22 to retract towards the rear of the connector 10 to ensure that the threads on the coupling nut do not contact the threads 52A on the female connector 52 (FIG. 5) should the user desire not to thread or couple the nut. Further, the retaining ring 24 exerts pressure on the coupling nut 22 when retracted, so that, should the connector be oriented with the nut 22 facing down, the retaining ring 24 exerts sufficient pressure to overcome the weight of the nut 22 and maintain it in a retracted position, as illustrated in FIG. 7. An exemplary material for the retaining ring is phosphor bronze.

Figure 8:
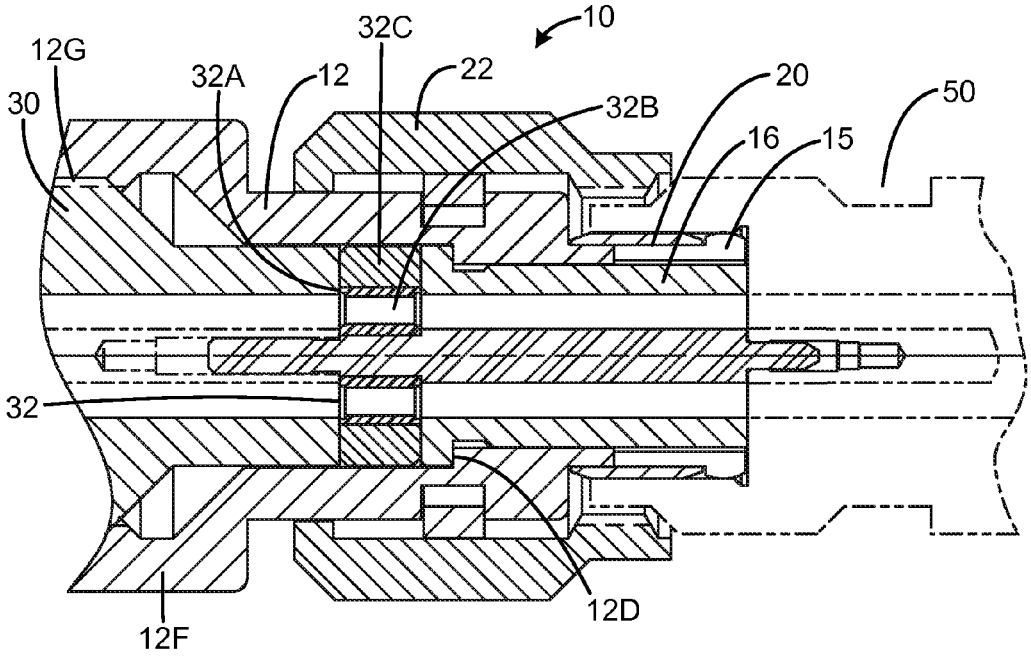
FIG. 8 is a cross-sectional view of a connector as in FIG. 4, illustrating exemplary bushing and dielectric features.

The connector structure 10 or 10A further includes an inner conductor pin 26 with a leading end pin region 27 of reduced diameter with respect to that of the pin 26. The leading end pin region 27 has a length of 0.054 inch in this exemplary embodiment. In this exemplary embodiment, the reduced length of pin region 27 allows the entry of the outer conductor 12 into the female connector outer conductor structure 52 (FIGS. 4-6) prior to the pin region 27 engaging the socket 54 of the female contact structure 56. In an alternative embodiment the length of the pin 27 can be reduced to allow increased engagement of the male outer conductor 12 into the female connector 50 prior to the pin 27 engaging the socket 54 of the female contact structure 56. Referring to FIG. 8, a support structure 30 supports the inner conductor within the connector, and includes a dielectric disc-like structure 32A with a central opening to receive the pin 26, with holes 32B formed through the dielectric structure, and an annular (electrically conductive) metal ring structure 32C formed about the outer periphery of the dielectric structure. A plurality of holes 32B are formed in the dielectric structure 32A between the pin 26 and the metal ring 32C. The support structure 30 is designed to maintain 50 ohm characteristic impedance of the connector. FIG. 8 shows the support structure 32 being held in place by a threaded bushing 30 that threads to the rear socket 12G of the connector body 12 which in turn applies 360 degree pressure through structure 30 to the outer coaxial connector structure 16 at surface 12D ensuring excellent electrical contact. The metal ring portion 32C provides excellent electrical contact between the bushing 30 and the coaxial outer conductor structure 16.

Figure 2:
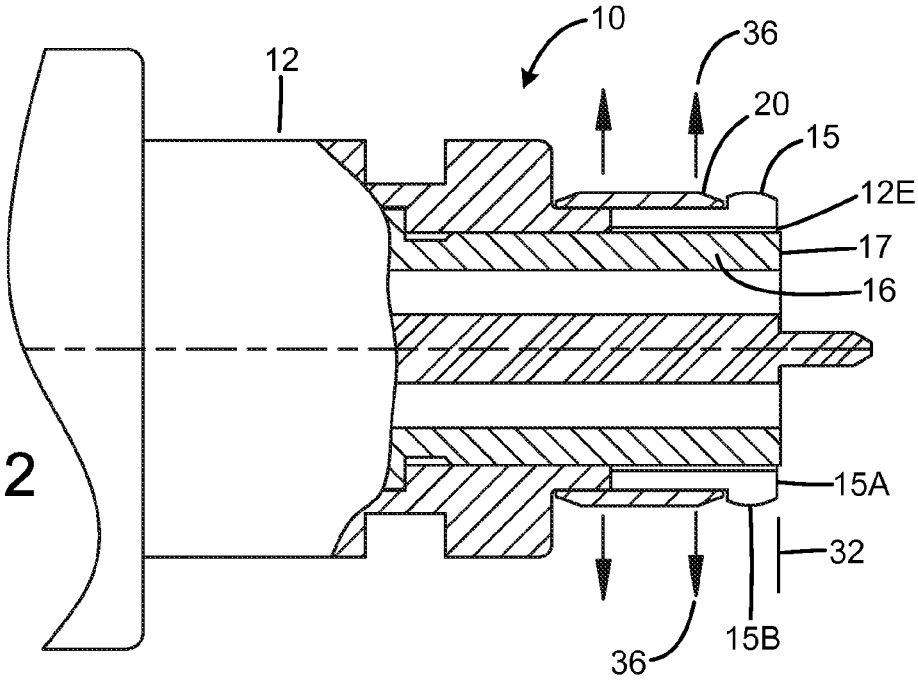
FIG. 2 is a view similar to FIG. 1, without the nut and retaining ring.

FIG. 2 shows the connector 10 with the coupling nut 22 and retaining ring 24 removed. This view illustrates the basic configuration to use the connector 10 for performing quick connect/disconnects during test. The nut 22 and retaining ring 24 are typically employed should the user desire to make a threaded coupling to verify the measurement accuracy or when a network analyzer calibration is being performed and the connector is used as the calibrated test port. Also, normal pressure applied (typical 8 in/lbs) for conventional connector structures to the mating interface 32 (FIGS. 2 and 4) is not necessary to achieve excellent repeatability from 0 Hz to 50 GHz frequency range, even when the connection is coupled and de-coupled repeatably through 360 degree rotation. The arrows 36 in FIGS. 2 and 3 indicate the direction of the applied force exerted by the compression fingers 15 and compression ring 20 on the female connector structure during and after mating. Similar considerations apply to the connector structure 10A.

Figure 3:
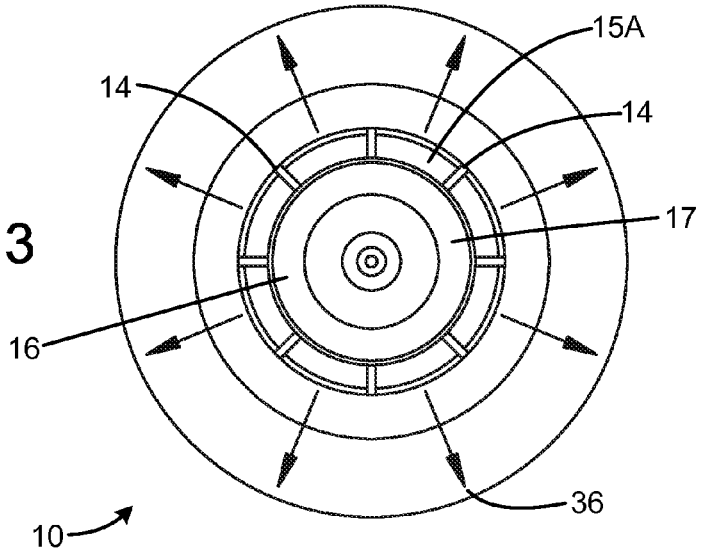
FIG. 3 is an end view showing the solid outer conductor surrounded by the slotted compression fingers.

FIG. 3 shows an end view of the connector structure 10, and in this exemplary embodiment, the slots 14 are disposed at 45 degree spacing from adjacent slots. The number of slots is not critical. The width of the slots 14 is preferably held as small as possible to minimize RF leakage at the higher operating frequencies. For this exemplary embodiment, in which the connector structure 12 has an inner diameter of 0.0945 inch when engaged with the female connector, the slots have a typical width of 0.006 inch. Similar considerations apply to the connector structure 10A.

FIG. 4 shows the normal retracted position of the coupling nut 22 as used during test and also shows the male connector coaxial outer conductor 16 and the female connector outer conductor 52 where they contact at the interface plane 32. In this view, the outer surfaces of the leading ends of the fingers 15 of the slotted outer finger structure 12 are shown in the compressed condition when fully engaged with initial pressure applied to the connector body. The nut is fully retracted and is not engaged or threaded during use. This mode of operation provides the user the recommended method to conduct quick tests using the connector structure 10.

The connector structure 10 in an exemplary test application is intended to be used, and will provide optimum results, where the device-under-test (DUT) is supported and where the device fixed with the connector structure 10 is also reasonably supported. FIG. 5 depicts a device 102 fixed to the connector structure 10, and a DUT (Device Under Test) 104 connected to the female connector structure 50. In this exemplary application, the device 102 could be a network analyzer or other test instrument or component.

FIG. 5 shows the coupling nut 22 with the threads 22C fully engaged with the threads 52A on the mating female connector 50. By virtue of the small number of threads present on the coupling nut, with a minimum of one thread, engagement and disengagement is very rapid and can typically be executed 2-3 times faster than engaging a standard fully threaded nut having 2-4 times the thread length. In this position, the coupling nut 22 can also be torqued to the recommended torque value of 8 in/lbs using a commercially available torque wrench. The electrical repeatability of a mated pair of connectors, when hand torqued or torqued using a torque wrench, is practically identical. This allows the user the option of torqueing a mated pair of connectors during calibration or test to guarantee very exacting results, or hand torque the connectors very rapidly as a test mode of operation or to verify a push/pull, engage/disengage test where results of the mating are unstable for any reason.

FIG. 6 shows a configuration of the connector structure 10, less coupling nut 22 and retaining ring 24, mated to the female connector structure 50. In this configuration, the connector structure 10 is used in the push-to-engage, pull-to-disengage mode of operation. Here, the connector offers excellent electrical repeatability. This configuration is recommended where speed is of the essence in coupling the DUT to test devices and is ideal for manual or automated test fixtures or setups.

This configuration of an outside slotted finger structure 12 with compression fingers 15 used with a solid (continuous) coaxial outer conductor 16 can be applied to a variety of connector types having reasonably thick outer walls (of structure 12) which will allow a recess to be provided where the compression ring can reside, and expanded to provide a spring compression fit with a mating female connector. If the wall is too thin to allow a compression ring, the connector 10A may be used.

Microwave connectors and test adapters employing this connector can be inexpensively produced and quickly connected and disconnected from a microwave coupling while maintaining a highly repeatable and low VSWR junction. Another aspect of this invention is a connector that can either be used in the push on/pull off mode or in the threaded mode as desired by the user.

Although the foregoing has been a description and illustration of specific embodiments of the subject matter, various modifications and changes thereto can be made by persons skilled in the art without departing from the scope and spirit of the invention.

What is claimed is:

1. A male coaxial connector structure for mating with a corresponding female connector structure to provide electrical connections at microwave frequencies, the female connector having a coaxial conductor structure with an outer conductor receptacle, the male coaxial connector structure comprising:

a coaxial outer conductor structure having a central longitudinal axis and a central open region about the axis and having a face region at a leading end of the outer conductor structure, the outer conductor structure defining a continuous uninterrupted coaxial outer conductor surface;

an outer conductive compression finger structure disposed outside of and adjacent the coaxial outer conductor surface and having a plurality of longitudinally oriented slots having a length adequate to form individual finger regions comprising the compression finger structure and to ensure proper spring action of the finger regions;

a center conductor pin structure disposed within the central open region and extending along the longitudinal axis;

the face region of the coaxial outer conductor structure configured to contact a corresponding face surface of the coaxial outer conductor structure of the female conductor with the male and female connectors mated together, providing intimate electrical contact between the coaxial outer conductors of the male and female connectors, to provide an uninterrupted coaxial outer conductor system;

wherein the finger regions of the outer compression finger structure are configured to compress to fit into the outer conductor receptacle of the female connector;

wherein the outer compression finger structure comprises a connector body with an internal cylindrical surface surrounding an open area between the compressive finger structure and the center conductive pin structure; and the coaxial outer conductor structure is fitted within the connector body, within the open area.

2. The coaxial connector structure of claim 1, wherein the coaxial outer conductor surface is cylindrical.

3. The coaxial connector structure of claim 1, wherein the outer compression finger structure has a recess formed therein over a portion of the finger region, the finger region at the leading end having respective regions of increased outer dimensions with respect to an outer dimension of the receptacle in the female connector; coaxial connector structure further comprising:

a compression ring disposed about the compression finger structure in the recess and positioned such that upon insertion of the male connector structure into the female connector structure, the regions of increased outer diameter of the finger regions engage and make mechanical contact with the female connector structure, and the ring engages the female connector structure and the finger regions of the outer conductor structure to support the finger regions.

4. The coaxial connector structure of claim 1 further comprising:

a coupling nut disposed about the outer compression finger structure to provide the option of a threaded coupling with the female connector structure.

5. The coaxial connector structure of claim 1, wherein the face region of the coaxial outer conductor is flat or convex.

6. The coaxial connector structure of claim 1, wherein the male coaxial connector structure is configured to be mated to the corresponding female connector structure and connected and disconnected using a simple push on/pull off motion.

7. The coaxial connector structure of claim 3, wherein the connector structure has a rated operating frequency range from 0 to 50 GHz.

8. The coaxial connector structure of claim 1, wherein:

the coaxial outer conductor structure includes a peripheral flange extending laterally out from an interior end of the outer conductor structure; and the outer compression finger structure comprises a connector body of the outer compression finger structure having a recess defining a shoulder surface at an interior end of the structure;

the coaxial outer conductor structure is fitted within the connector body, with the flange fitting into the recess against the shoulder and registering an axial position of the coaxial outer conductor.

9. A male coaxial connector structure for mating with a corresponding female connector structure to provide electrical connections at microwave frequencies, the female connector having a coaxial conductor structure with an outer conductor receptacle, the male coaxial connector structure comprising:

a coaxial outer conductor structure having a central longitudinal axis and a central open region about the axis and having a face region at a leading end of the outer conductor structure, the outer conductor structure defining a continuous uninterrupted coaxial outer conductor surface, wherein the coaxial outer conductor surface is cylindrical;

an outer conductive compression finger structure disposed outside of and adjacent the coaxial outer conductor surface and having a plurality of longitudinally oriented slots having a length adequate to form individual finger regions comprising the compression finger structure and to ensure proper spring action of the finger regions;

a center conductor pin structure disposed within the central open region and extending along the longitudinal axis;

the face region of the coaxial outer conductor structure configured to contact a corresponding face surface of the coaxial outer conductor structure of the female conductor with the male and female connectors mated together, providing intimate electrical contact between the coaxial outer conductors of the male and female connectors, to provide an uninterrupted coaxial outer conductor system;

wherein the finger regions of the outer compression finger structure are configured to compress to fit into the outer conductor receptacle of the female connector; and wherein:

the coaxial outer conductor structure includes a peripheral flange extending laterally out from an interior end of the outer conductor structure; and the outer compression finger structure has an internal cylindrical surface surrounding an open area, with a recess defining a shoulder surface at an interior end of the structure;

the inner diameter (ID) of the cylindrical surface of the compression finger structure is slightly larger than the outer diameter (OD) of the coaxial outer conductor, allowing the coaxial outer conductor structure to be received within the open area of the compression finger structure, with the flange fitting into the recess against the shoulder and registering an axial position of the coaxial outer conductor.

10. A male coaxial connector structure for mating with a corresponding female connector structure to provide electrical connections at microwave frequencies, the female connector having a coaxial conductor structure with an outer conductor receptacle, the male coaxial connector structure comprising:

a coaxial outer conductor structure having a central longitudinal axis and a central open region about the axis and having a face region at a leading end of the outer conductor structure, the outer conductor structure defining a continuous uninterrupted coaxial outer conductor surface;

an outer conductive compression finger structure disposed outside of and adjacent the coaxial outer conductor surface and having a plurality of longitudinally oriented slots having a length adequate to form individual finger regions comprising the compression finger structure and to ensure proper spring action of the finger regions;

a center conductor in structure disposed within the central open region and extending along the longitudinal axis;

the face region of the coaxial outer conductor structure configured to contact a corresponding face surface of the coaxial outer conductor structure of the female conductor with the male and female connectors mated together, providing intimate electrical contact between the coaxial outer conductors of the male and female connectors, to provide an uninterrupted coaxial outer conductor system;

wherein the finger regions of the outer compression finger structure are configured to compress to fit into the outer conductor receptacle of the female connector; and wherein the finger regions of the outer compression finger structure terminate at a shorter face recessed behind the face region of the coaxial outer conductor structure to ensure intimate contact between said face region and the corresponding face surface of the coaxial outer conductor structure of the female connector and such that the face of the finger regions does not contact the corresponding face surface of the coaxial outer conductor structure of the female connector.

11. A male coaxial connector structure for mating with a corresponding female connector structure to provide electrical connections at microwave frequencies, the male coaxial connector structure comprising:

a coaxial outer conductor structure having a central longitudinal axis and a central hollow region about the axis and having a face region at a leading end of the outer conductor structure, the outer conductor structure defining a continuous coaxial outer conductor surface;

an outer conductive compression finger structure disposed about the coaxial outer conductor surface and having a plurality of longitudinally oriented slots having a length adequate to form individual finger regions comprising the compression finger structure and to ensure proper spring action of the finger regions;

wherein the outer compression finger structure comprises a connector body with an internal cylindrical surface surrounding an open area, and the coaxial outer conductor structure is fitted within the connector body, within the open area between the compressive finger structure and the center conductive pin structure;

the outer compression finger structure defining a circumferential recess over a portion of the finger regions, the finger regions adjacent tips of the finger regions having respective regions of increased outer dimension with respect to an outer dimension of the recess;

a center conductor pin structure disposed within the central hollow region and extending along the longitudinal axis;

a compression ring structure positioned in said recess over the finger regions, wherein upon insertion of the male connector structure into the female connector structure, the regions of increased outer dimension of the finger regions engage and make mechanical contact with an outer conductor surface of the female connector structure, and the ring structure engages the conductor surface and the finger regions to mechanically support the finger regions of the compression finger structure, the face region of the outer conductor structure making electrical contact with a corresponding face region of the outer conductor structure of the female connector, resulting in electrically repeatable couplings.

12. The male connector structure of claim 11 wherein the finger regions are fabricated of a resilient material, and are spread outwardly to form an oversized leading end outer diameter, and wherein upon engagement of the end regions of the finger regions with the female connector structure, the end regions of the finger regions are compressed to a nominal connector diameter.

13. The male connector structure of claim 11 wherein the compression ring structure is fabricated of an electrically conductive material, wherein the compression ring provides shielding against leakage of RF energy through said slots.

14. The male connector structure of claim 11 wherein said outer conductor structure and said compression ring structure are fabricated of beryllium copper or phosphor bronze.

15. The male connector structure of claim 11, wherein the outer conductor structure and compression ring structure are adapted for connection and disconnection with the female connector structure using a simple push on/pull off motion without the need for other action.

16. The male connector structure of claim 11 further comprising:

an integral coupling nut disposed about the outer conductor structure to provide the option of a threaded coupling with the female connector structure.

17. The male connector structure of claim 16 wherein the coupling nut is threaded so as to provide engagement of one to two threads with a threaded structure on the female connector structure, providing the ability to quickly thread or unthread the coupling nut from the threaded structure.

18. The male connector structure of claim 16 wherein the coupling nut is fabricated with an inner area between inner spaced shoulders of increased diameter, forming an elongated relief area which allows the coupling nut to retract to ensure that the threads on the coupling nut do not contact threads on the female connector structure should the user desire not to thread or couple the nut.

19. The male coaxial connector structure of claim 11, wherein the connector structure has a rated operating frequency range from 0 to 50 GHz.

20. The coaxial connector structure of claim 11, wherein:

the coaxial outer conductor structure includes a peripheral flange extending laterally out from an interior end of the outer conductor structure; and the outer compression finger structure comprises a connector body of the outer compression finger structure having a recess defining a shoulder surface at an interior end of the structure;

the coaxial outer conductor structure is fitted within the connector body, with the flange fitting into the recess against the shoulder and registering an axial position of the coaxial outer conductor.

* * * * *